US006182597B1

(12) United States Patent
Maxwell et al.

(10) Patent No.: US 6,182,597 B1
(45) Date of Patent: Feb. 6, 2001

(54) BOAT LAUNCH APPARATUS

(76) Inventors: Albert D. S. Maxwell; Margaret R. D'eon, both of 1420 Credit Woodlands Court, Mississauga, Ontario (CA), L5C 3J5

( * ) Notice: Under 35 U.S.C. 154(b), the term of this patent shall be extended for 0 days.

(21) Appl. No.: 09/434,813

(22) Filed: Nov. 5, 1999

(51) Int. Cl.[7] ..... B63C 13/00
(52) U.S. Cl. ..... 114/344; 405/2
(58) Field of Search ..... 114/344, 263; 405/1, 2

(56) References Cited

U.S. PATENT DOCUMENTS 4,507,016 * 3/1985 Honour, VII ..... 114/344
4,745,873 * 5/1988 Mott ..... 114/344
4,838,735 * 6/1989 Warner ..... 114/263

* cited by examiner

*Primary Examiner*—Jesus D. Sotelo

(57) ABSTRACT

A boat launch apparatus for moving various sized trailers up and down an incline. The boat launch apparatus includes a first rail assembly having a proximal and distal end. A second rail assembly substantially identical to the first rail assembly positioned generally parallel to the first rail assembly. The area between the first and second rail assemblies defines an interior area. A plurality of connecting rods connects the first rail assembly to the second rail assembly. The rods extend between the first and second rail assemblies. The rods each have a first end and a second end. Each of the first ends of the rods is fixedly coupled to an interior portion of the first rail assembly, and each of the second ends of the rods is fixedly coupled to the interior portion of the second rail assembly. The first and second ends of the rods are removably coupled such that the rods are adaptable to have a variable length. A plurality of adjustable height legs supports the rail assemblies. The trailer has a plurality of axles, each having a longitudinal axis is orientated generally perpendicular to a longitudinal axis of the first rail assembly. An elongate bar connects the axles. The axles each have a pair of ends. Each end of an axle has a wheel thereon. The wheels are adapted to roll on the rail assemblies.

6 Claims, 6 Drawing Sheets

BOAT LAUNCH APPARATUS

BACKGROUND OF THE INVENTION

1. Field of the Invention

The present invention relates to boat launch systems and more particularly pertains to a new boat launch apparatus for moving various sized trailers up and down an incline.

2. Description of the Prior Art

The use of boat launch systems is known in the prior art. More specifically, boat launch systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,215,405; U.S. Pat. No. 3,058,312; U.S. Pat. No. 2,395,423; U.S. Pat. No. 3,238,733; U.S. Pat. No. 1,316,831; and U.S. Pat. Des. No. 278,753.

While these devices fulfill their respective, particular objectives and requirements, the aforementioned patents do not disclose a new boat launch apparatus. The inventive device includes a first rail assembly having a proximal and distal end. A second rail assembly substantially identical to the first rail assembly positioned generally parallel to the first rail assembly. The area between the first and second rail assemblies defines an interior area. A plurality of connecting rods connects the first rail assembly to the second rail assembly. The rods extend between the first and second rail assemblies. The rods each have a first end and a second end. Each of the first ends of the rods is fixedly coupled to an interior portion of the first rail assembly, and each of the second ends of the rods is fixedly coupled to the interior portion of the second rail assembly. The first and second ends of the rods are removably coupled such that the rods are adaptable to have a variable length. A plurality of adjustable height legs supports the rail assemblies. The trailer has a plurality of axles, each having a longitudinal axis is orientated generally perpendicular to a longitudinal axis of the first rail assembly. An elongate bar connects the axles. The axles each have a pair of ends. Each end of an axle has a wheel thereon. The wheels are adapted to roll on the rail assemblies.

In these respects, the boat launch apparatus according to the present invention substantially departs from the conventional concepts and designs of the prior art, and in so doing provides an apparatus primarily developed for the purpose of moving various sized trailers up and down an incline.

SUMMARY OF THE INVENTION

In view of the foregoing disadvantages inherent in the known types of boat launch systems now present in the prior art, the present invention provides a new boat launch apparatus construction wherein the same can be utilized for moving various sized trailers up and down an incline.

The general purpose of the present invention, which will be described subsequently in greater detail, is to provide a new boat launch apparatus apparatus and method which has many of the advantages of the boat launch systems mentioned heretofore and many novel features that result in a new boat launch apparatus which is not anticipated, rendered obvious, suggested, or even implied by any of the prior art boat launch systems, either alone or in any combination thereof.

To attain this, the present invention generally comprises a first rail assembly having a proximal and distal end. A second rail assembly substantially identical to the first rail assembly positioned generally parallel to the first rail assembly. The area between the first and second rail assemblies defines an interior area. A plurality of connecting rods connects the first rail assembly to the second rail assembly. The rods extend between the first and second rail assemblies. The rods each have a first end and a second end. Each of the first ends of the rods is fixedly coupled to an interior portion of the first rail assembly, and each of the second ends of the rods is fixedly coupled to the interior portion of the second rail assembly. The first and second ends of the rods are removably coupled such that the rods are adaptable to have a variable length. A plurality of adjustable height legs supports the rail assemblies. The trailer has a plurality of axles, each having a longitudinal axis is orientated generally perpendicular to a longitudinal axis of the first rail assembly. An elongate bar connects the axles. The axles each have a pair of ends. Each end of an axle has a wheel thereon. The wheels are adapted to roll on the rail assemblies.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new boat launch apparatus and method which has many of the advantages of the boat launch systems mentioned heretofore and many novel features that result in a new boat launch apparatus which is not anticipated, rendered obvious, suggested, or even implied by any of the prior art boat launch systems, either alone or in any combination thereof.

It is another object of the present invention to provide a new boat launch apparatus which may be easily and efficiently manufactured and marketed.

It is a further object of the present invention to provide a new boat launch apparatus which is of a durable and reliable construction.

An even further object of the present invention is to provide a new boat launch apparatus which is susceptible of a low cost of manufacture with regard to both materials and labor, and which accordingly is then susceptible of low prices of sale to the consuming public, thereby making such boat launch apparatus economically available to the buying public.

Still yet another object of the present invention is to provide a new boat launch apparatus which provides in the apparatuses and methods of the prior art some of the advantages thereof, while simultaneously overcoming some of the disadvantages normally associated therewith.

Still another object of the present invention is to provide a new boat launch apparatus for moving various sized trailers up and down an incline.

Yet another object of the present invention is to provide a new boat launch apparatus which includes a first rail assembly having a proximal and distal end. A second rail assembly substantially identical to the first rail assembly positioned generally parallel to the first rail assembly. The area between the first and second rail assemblies defines an interior area. A plurality of connecting rods connects the first rail assembly to the second rail assembly. The rods extend between the first and second rail assemblies. The rods each have a first end and a second end. Each of the first ends of the rods is fixedly coupled to an interior portion of the first rail assembly, and each of the second ends of the rods is fixedly coupled to the interior portion of the second rail assembly. The first and second ends of the rods are removably coupled such that the rods are adaptable to have a variable length. A plurality of adjustable height legs supports the rail assemblies. The trailer has a plurality of axles, each having a longitudinal axis is orientated generally perpendicular to a longitudinal axis of the first rail assembly. An elongate bar connects the axles. The axles each have a pair of ends. Each end of an axle has a wheel thereon. The wheels are adapted to roll on the rail assemblies.

Still yet another object of the present invention is to provide a new boat launch apparatus that includes a rail system which can be adjusted to various widths in order to accommodate different sized trailers having multiple purposes.

Even still another object of the present invention is to provide a new boat launch apparatus that can be used to hold a platform for easy access up and down a slope.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
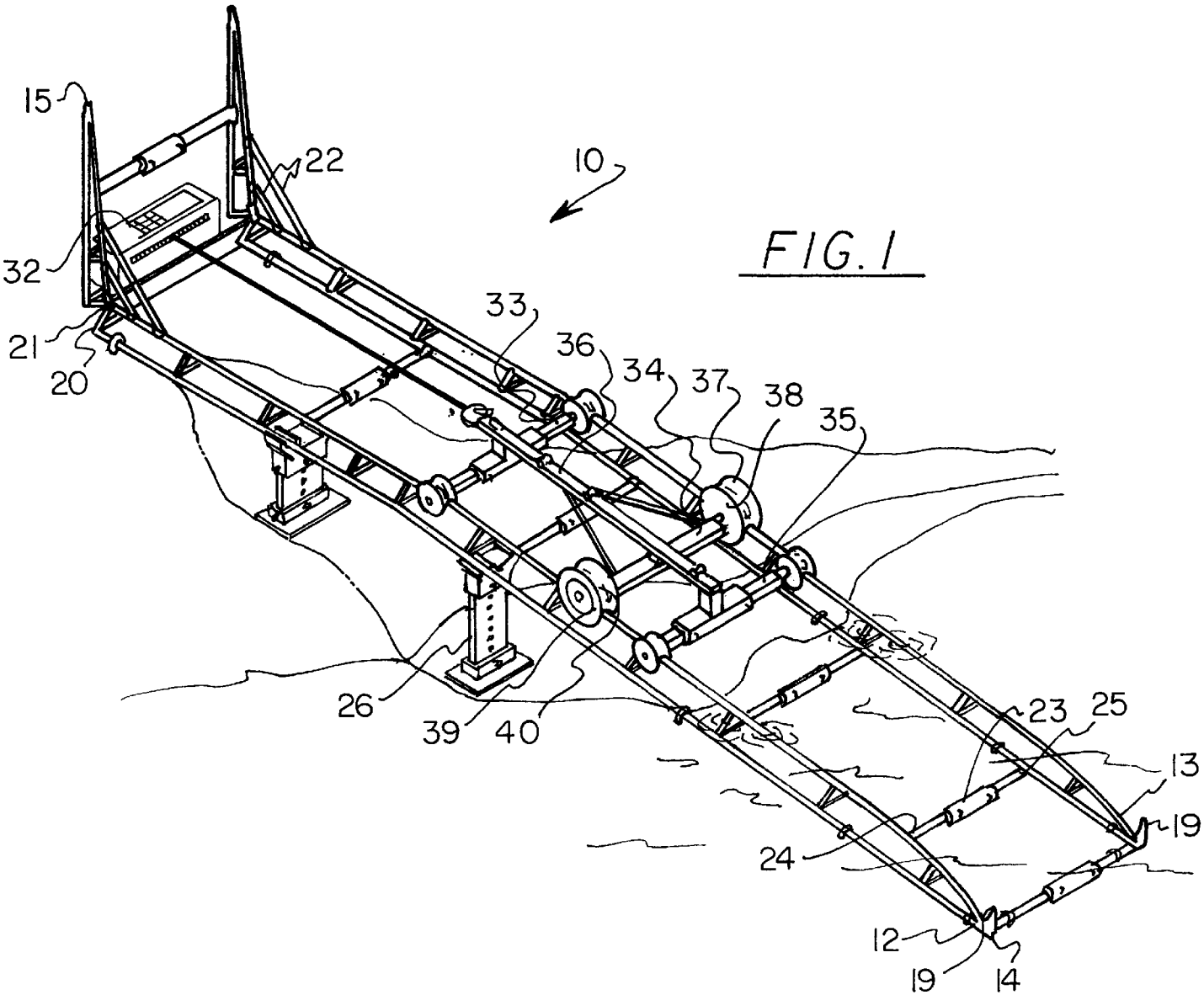
FIG. 1 is a schematic perspective view of the preferred embodiment of a new boat launch apparatus according to the present invention.

With reference now to the drawings, and in particular to FIGS. 1 through 6 thereof, a new boat launch apparatus embodying the principles and concepts of the present invention and generally designated by the reference numeral 10 will be described.

As best illustrated in FIGS. 1 through 6, the boat launch apparatus 10 generally comprises a first rail 12 assembly for guiding a trailer. The first rail assembly has a distal end 14 and a proximal end 15. The first rail assembly comprises an upper rail 16 and two lower shafts 17, 18. Each of the lower shafts is elongate, has a longitudinal axis, and extends substantially parallel to each other. A cross section of the first rail assembly 12 is configured as an equilateral triangle with the upper rail 16 lying at one apex of the equilateral triangle and the lower shafts 17, 18 each lying at the other apexes of the equilateral triangle. The triangle has an apex directed upward and a horizontal base. The upper rail 16 forms the apex. The distal end 14 has an upstanding member 19 thereon that is fixedly coupled to and extends upwardly away from the distal end of the rail assembly. The rail has a gap 20 located at a point between a midsection of the first rail assembly and the proximal end of the first rail assembly. The gap 20 defines two portions of the first rail assembly. The portions are hingedly coupled together by a hinge 21. The hinge is mounted on the upper rail 16 such that the proximal end 15 of the first rail assembly is capable of being lifted upward such that the portions of the first rail assembly are oriented generally perpendicular to each other. Ideally, the portions are connected by a series of support bars 22 which will hold the two portions in a perpendicular configuration.

The upper rail bends downward at the distal end and at the proximal end such that the upper rail 16 extends to a point generally between the two lower shafts 17, 18. The lower shafts bend toward each other at the distal end 14 and the proximal end 15 such that the upper rail and the lower shafts intersect each other to define a point.

A second rail assembly 13 for guiding the trailer is substantially identical to the first rail. The second rail assembly extends parallel to the first rail assembly 12 and is aligned with the first rail assembly such that a line drawn perpendicular to the longitudinal axis of the first rail assembly and intersecting the proximal end of the first rail assembly will intersect a proximal end of the second rail assembly.

The area between the first and second rail assemblies defines an interior area, such that one of the lower shafts 18, is defined as an interior lower shaft.

A plurality of connecting rods 23 connects the first rail 12 assembly to the second rail assembly 13. The rods 23 extend between the first and second rail assemblies. The rods each have a first end 24 and a second end 25. The first ends 24 of the rods are fixedly coupled to the interior bottom shaft 18 of the first rail 12. The second ends 25 of the rods are fixedly coupled to the interior bottom shaft 18 of the second rail 13. The first and second ends of the rods are removably coupled such that the rods are adaptable to have a variable length, wherein the lengths of the rods are adjustable to vary the distance between the first and second rail assemblies.

Preferably, two legs 26 for supporting the rail assemblies are attached to each of the first and the second rail assemblies. Each of the legs has an adjustable height. The height can be adjusted by any known means however a base 27 slidably mounted in leg 28 with bores 29 therein to be secured by a pin 30 is preferred.

Preferably, a winch 32 is used for pulling the trailer on the rails. Ideally, the winch is electrically powered. The winch is generally located adjacent to the proximal ends 15 of the first 12 and the second rails 13. The winch is also generally located between the proximal ends of the first and second rails and is mounted to the first and second rail assemblies.

Figure 5:
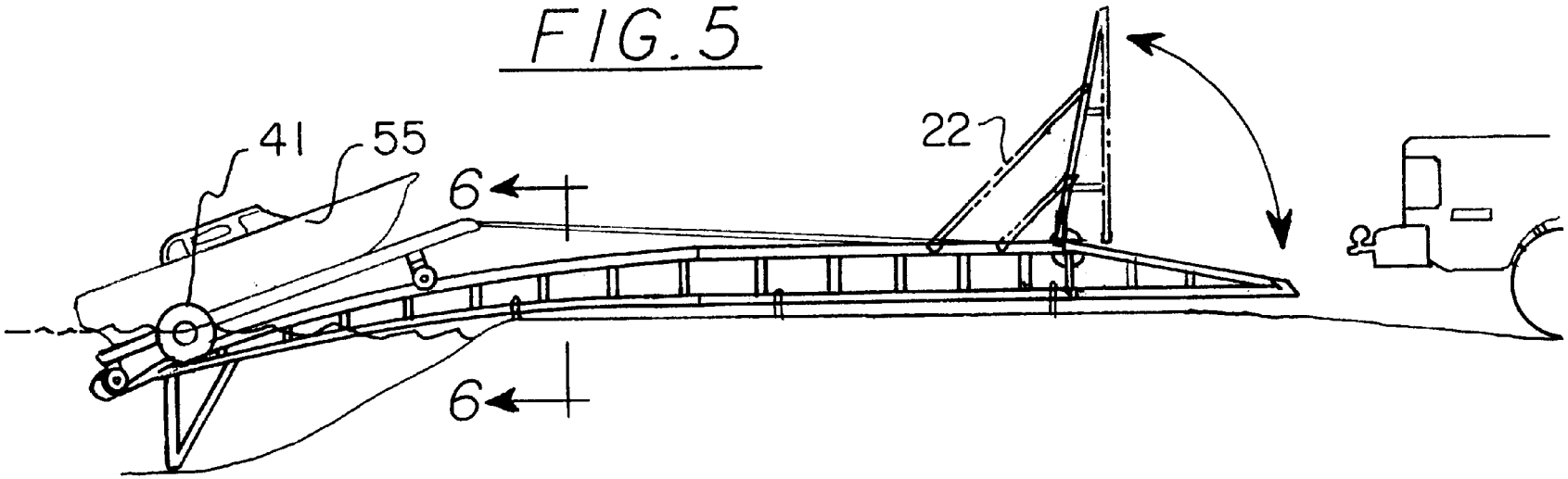
FIG. 5 is a schematic side view of the preferred embodiment of the present invention.
Figure 6:
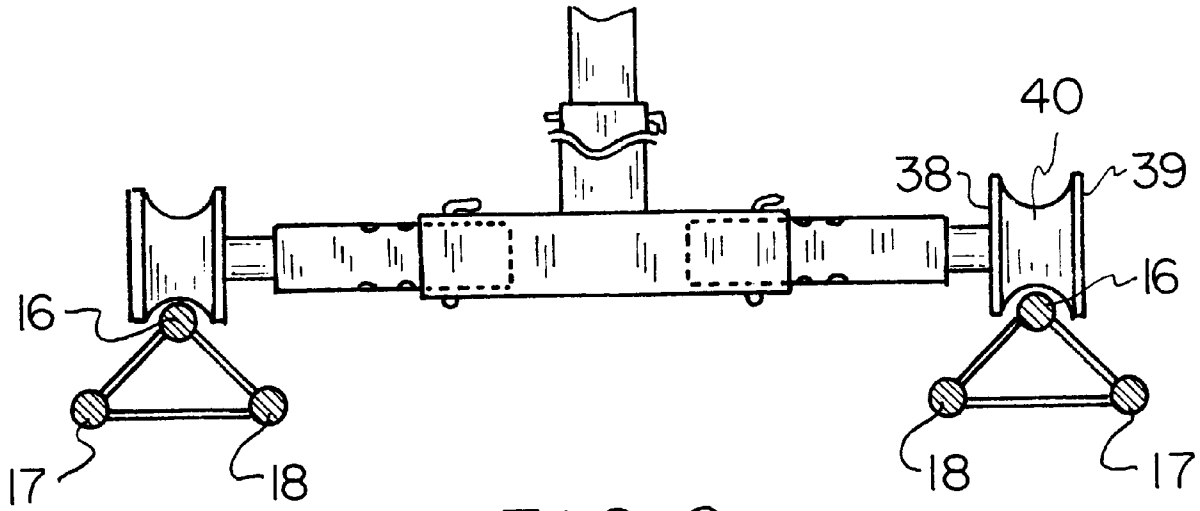
FIG. 6 is a schematic front view of an axle of the present invention.
Figure 7:
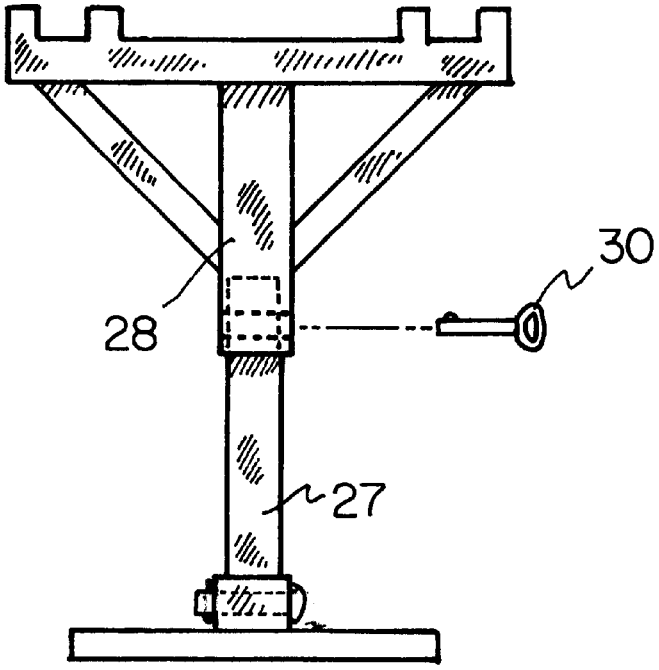
FIG. 7 is a schematic front view of an adjustable leg of the present invention.
Figure 8:
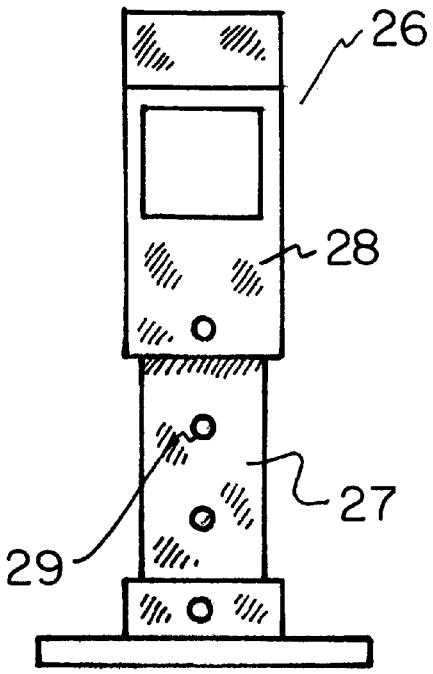
FIG. 8 is a schematic side view of an adjustable leg of the present invention.

The preferred trailer is depicted in FIGS. 1 and 5. This trailer is primarily used for transporting a boat. The trailer has a first axle 33, second axle 34 and third axle 35, wherein the second axle 34 is positioned between the first axle 33 and third axles 35. As is depicted in FIG. 6, ideally the axles have an adjustable length. Each of the axles has a longitudinal axis orientated generally perpendicular to the longitudinal axis of the first rail assembly 12. An elongate bar 36 connects the axles. The elongate bar has a longitudinal axis generally perpendicular to the longitudinal axis of the axles. The elongate bar is fixedly coupled to the first axle 33 and second axles 34, however the third axle 35 is removably coupled to the elongate bar for removal when the trailer is taken on a roadway. The junctures of the elongate bar and the axles are positioned generally at longitudinal midpoints of the axles. Each of the axles has a pair of ends. The ends of the axles each have a wheel 37 thereon. The wheels have an inside portion 38 and an outside portion 39 such that the inside portion 38 of the wheels are rotationally coupled to the ends of the axles. The wheels have a perimeter surface 40 between the inside and outside portions. The perimeter surface 40 of each of the wheels is concave so that the wheels are adapted to ride on the upper rail 16 of the first and second rail assemblies.

On the boat trailer, a pair of tires 41 supports the trailer for use on a roadway. One of the tires is mounted to an outside portion 39 of each of the wheels which are mounted to the second axle 34. The tires 41 have a circumference greater than the wheels 37 to which they are attached. The first axle 33 is closer in proximity to the proximal end 15 of the rail than is the third axle 35.

Preferably, the elongate bar 36 has an end adapted to be removably coupled to the winch 32.

Figure 2:
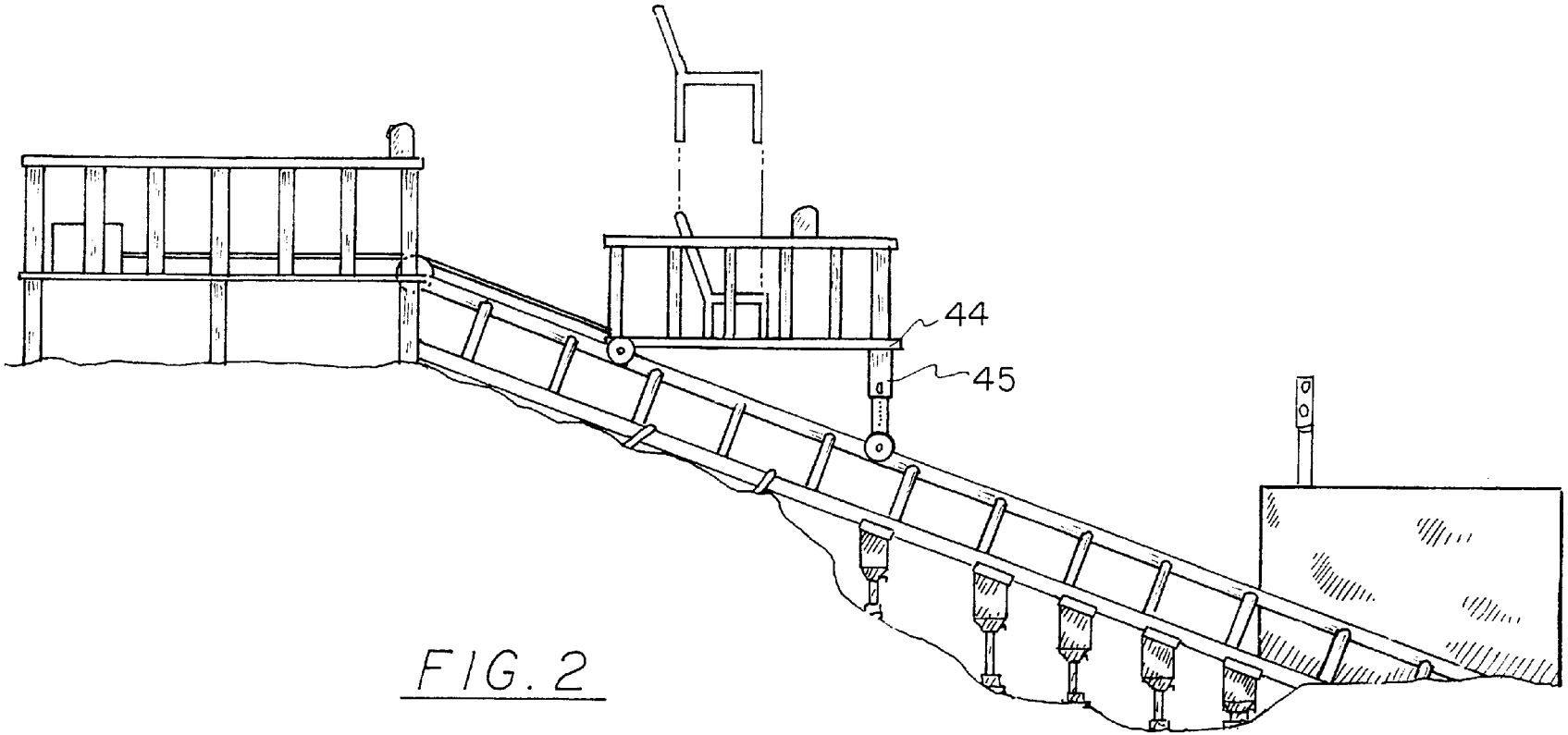
FIG. 2 is a schematic side view of the second embodiment of the present invention.
Figure 3:
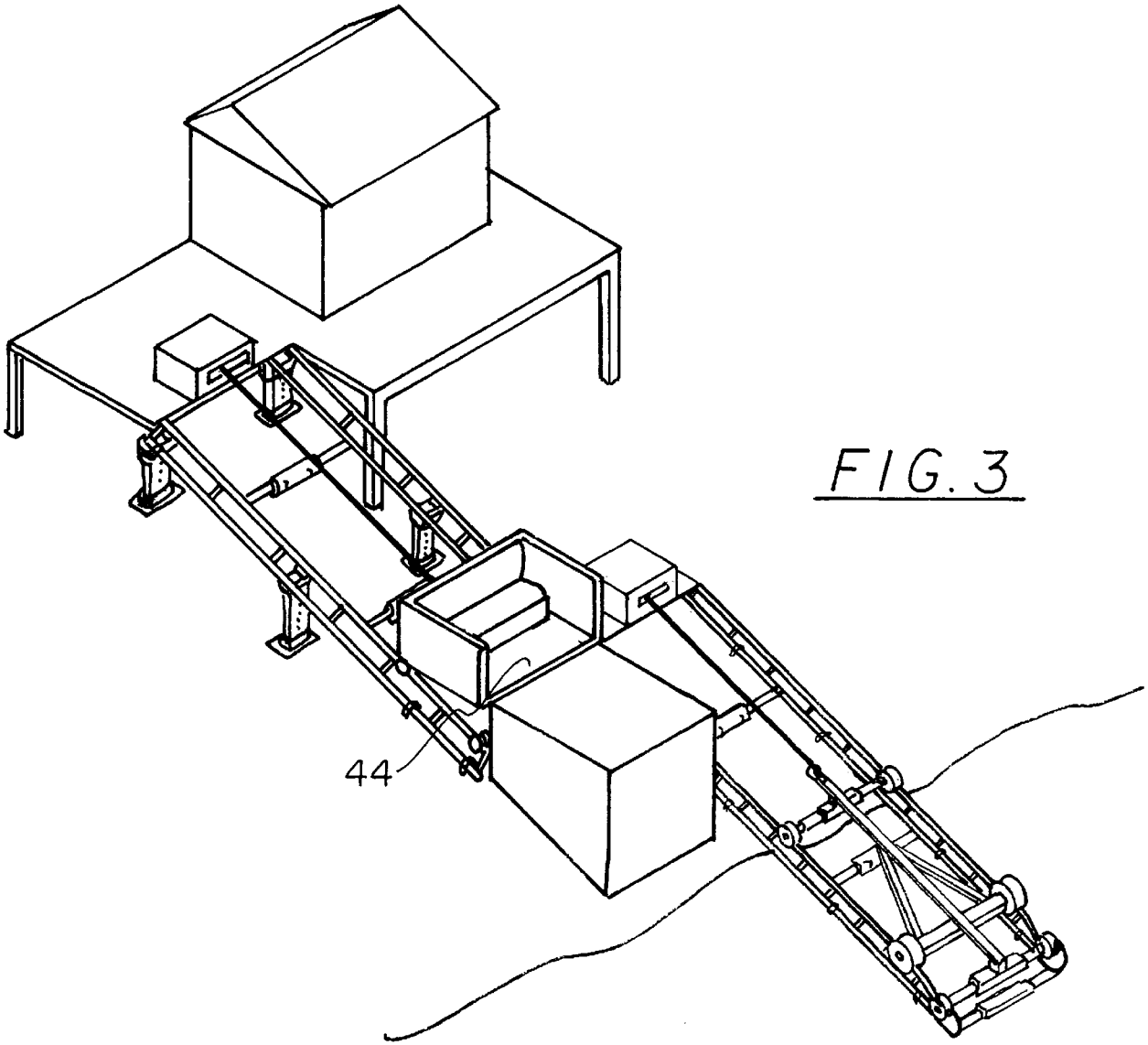
FIG. 3 is a schematic perspective view of another configuration of the second embodiment of the present invention.

In the second embodiment, as best depicted in FIGS. 2 and 3, the trailer has a platform 44 mounted to it. The platform can be used to carry people and items up and down a slope. This embodiment contains adjustable legs 45 which couple the platform to the axles of the trailer. The legs are adjusted so that the platform 44 remains in a horizontal position as it is lowered and raised on the slope.

Figure 4:
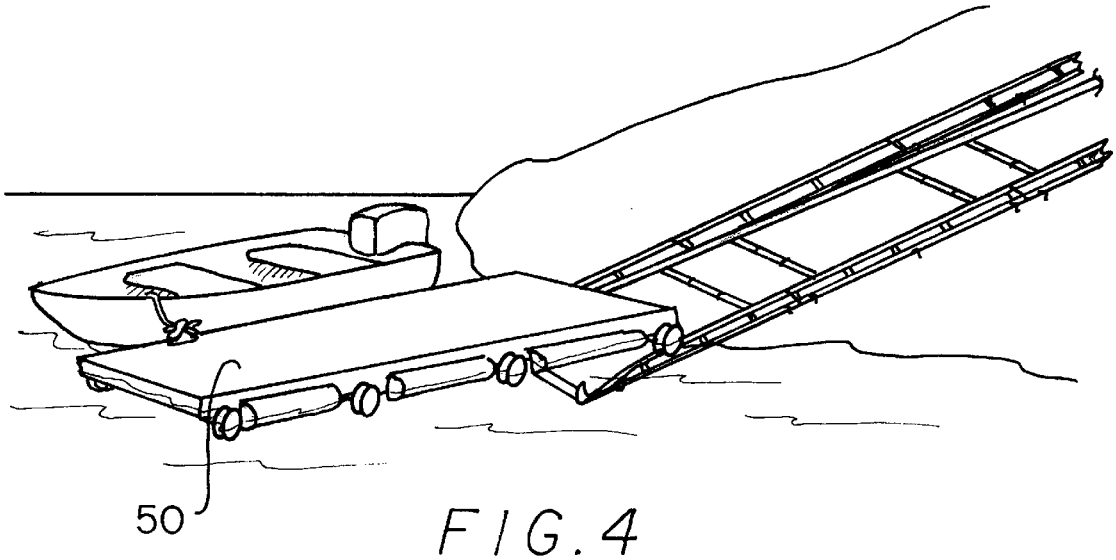
FIG. 4 is a schematic perspective view of the third embodiment of the present invention.

The third embodiment is depicted in FIG. 4. This embodiment employs the trailer for lifting and lowering a dock 50 out of the water. In colder climates a dock must be removed from the water before the water freezes. This apparatus will allow the quick and easy removal of a floating dock.

In use, all three embodiments function in the same way. The trailer is hooked up to a winch. The winch pulls the trailer up and down the slope of the rail. For the boat launch, which is depicted in FIGS. 1 and 5, the boat 55 is lowered into the water on its trailer and then released from the trailer. To remove the boat from the water the reverse process is performed.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An apparatus for moving a trailer up and down an incline, comprising:

a first rail assembly having a proximal and distal end;

a second rail assembly, said second rail assembly being substantially identical to said first rail assembly, said second rail assembly being oriented generally parallel to said first rail assembly;

wherein the area between said first and second rail assemblies defines an interior area;

a plurality of connecting rods for connecting the first rail assembly to the second rail assembly, said rods extending between said first and second rail assemblies, said rods each having a first end and a second end, each of said first ends of said rods being fixedly coupled to an interior portion of said first rail assembly, each of said second ends of said rods being fixedly coupled to said interior portion of said second rail assembly, each of said first and second ends of said rods being removably coupled such that said rods are adaptable to have a variable length, wherein the lengths of the rods are adjustable to vary the distance between said first and second rail assemblies;

a plurality of legs for supporting the rail assemblies, said legs having an adjustable height;

said trailer having a plurality of axles, each of said axles having a longitudinal axis being orientated generally perpendicular to a longitudinal axis of said first rail assembly, said axles being connected by an elongate bar, said elongate bar being fixedly coupled to each of said axles, each of said axles having a pair of ends, each of said ends of said axles having a wheel thereon, each of said wheels being adapted to roll on said rail assemblies, each of said wheels having an inside portion rotationally coupled to said ends of said axles.

2. The apparatus for moving a trailer up and down an incline as in claim 1, wherein said rail assemblies comprise:

said first rail assembly comprising an upper rail and two lower shafts, each of said lower shafts being elongate, each of said shafts having a longitudinal axis, each of said longitudinal axes of said shafts extending substantially parallel to each other, a cross section of said first rail assembly being configured as an equilateral triangle with said upper rail lying at one apex of said equilateral triangle and said lower shafts each lying at the other apexes of said equilateral triangle, said triangle having an apex directed upward and a horizontal base, said upper rail forming said apex;

said second rail assembly extending parallel to said first rail, said second rail assembly being aligned with said first rail assembly such that a line drawn perpendicular to said longitudinal axis of said first rail assembly and intersecting said proximal end of said first rail assembly will intersect a proximal end of said second rail;

wherein the area between said first and second rail assemblies defines an interior area, such that an interior lower shaft of said first and second rail assemblies is defined.

3. The apparatus for moving a trailer up and down an incline as in claim 1, further comprising;

an electric winch for pulling said trailer on said rails, said winch being generally located adjacent to said proximal ends of said first and said second rails assemblies, said winch being generally located between said proximal ends of said first and second rails assemblies, said winch being mounted to said first and second rail assemblies.

4. The apparatus for moving a trailer up and down an incline as in claim 1, wherein said trailer is adapted for carrying a boat, said trailer comprising:

a first, second and third axle, wherein said second axle is positioned between said first and third axles, each of said axles having a longitudinal axis being orientated generally perpendicular to said longitudinal axis of said first rail assembly, said axles being connected by an elongate bar, said elongate bar having a longitudinal axis generally perpendicular to said longitudinal axis of said axles, said elongate bar being fixedly coupled to said first and second axle, said elongate bar being removably coupled to said third axle, a juncture of said elongate bar and said axles being positioned generally at longitudinal midpoints of said axles, each of said wheels having an outside portion, each of said wheels having a perimeter surface between said inside and outside portions, said wheels being adapted to ride on said upper rail of said first and second rails, wherein said perimeter surface of each of said wheels is concave;

a pair of tires for supporting said trailer on a roadway, one of said tires being mounted to an outside portion of each of said wheels which are mounted to said second axle, said tires having a circumference greater than the wheels to which they are attached; and wherein said elongate bar has an end adapted to be removably coupled to a winch.

5. The apparatus for moving a trailer up and down an incline as in claim 1, wherein said trailer is adapted to be a horizontal platform, said trailer having adjustable legs connecting said axles to said platform, such that the legs are adjustable to maintain a level platform when said rail assemblies are not level.

6. An apparatus for launching and retrieving a boat from a body of water, comprising:

a first rail assembly for guiding a trailer, said first rail assembly having a distal end and a proximal end, said first rail assembly comprising an upper rail and two lower shafts, each of said lower shafts being elongate, each of said shafts having a longitudinal axis, each of said longitudinal axes of said shafts extending substantially parallel to each other, a cross section of said first rail assembly being configured as an equilateral triangle with said upper rail lying at one apex of said equilateral triangle and said lower shafts each lying at the other apexes of said equilateral triangle, said triangle having an apex directed upward and a horizontal base, said upper rail forming said apex, said distal end having an upstanding member thereon, said upstanding member being fixedly coupled to and extending upwardly away from said distal end of said rail, said rail having a gap therein, said gap being located at a point between a midsection of said first rail assembly and the proximal end of said first rail assembly, said gap defining two portions of said first rail assembly, said portions being hingedly coupled together by a hinge, said hinge being mounted on said upper rail such that said proximal end of said first rail assembly is capable of being lifted upward such that said portions of said first rail assembly are oriented generally perpendicular to each other;

wherein said upper rail bends downward at said distal end and said proximal end such that said upper rail extends to a point generally between said two lower shafts, said lower shafts bending toward each other at said distal end and said proximal end such that said upper rail and said lower shafts intersect each other to define a point, a second rail assembly for guiding said trailer, said second rail assembly being substantially identical to said first rail, said second rail assembly extending parallel to said first rail assembly, said second rail assembly being aligned with said first rail assembly such that a line drawn perpendicular to said longitudinal axis of said first rail assembly and intersecting said proximal end of said first rail assembly will intersect a proximal end of said second rail;

wherein the area between said first and second rail assemblies defines an interior area, such that an interior lower shaft of said first and second rail assemblies is defined;

a plurality of connecting rods for connecting the first rail assembly to the second rail assembly, said rods extending between said first and second rail assemblies, said rods each having a first end and a second end, each of said first ends of said rods being fixedly coupled to said interior bottom shaft of said first rail, each of said second ends of said rods being fixedly coupled to said interior bottom shaft of said second rail, each of said first and second ends of said rods being removably coupled such that said rods are adaptable to have a variable length, wherein the lengths of the rods are adjustable to vary the distance between said first and second rail assemblies;

four legs for supporting the rail assemblies, a pair of said legs being attached to said first and said second rail assemblies, each of said legs having an adjustable height;

an electric winch for pulling said trailer on said rails, said winch being generally located adjacent to said proximal ends of said first and said second rails, said winch generally being located between said proximal ends of said first and second rails, said winch being mounted to said first and second rail assemblies;

said trailer for transporting a boat, said trailer having a first, second and third axle, wherein said second axle is positioned between said first and third axles, each of said axles having a longitudinal axis being orientated generally perpendicular to said longitudinal axis of said first rail assembly, said axles being connected by an elongate bar, said elongate bar having a longitudinal axis generally perpendicular to said longitudinal axis of said axles, said elongate bar being fixedly coupled to said first and second axles, said third axle being removably coupled to said elongate bar, a juncture of said elongate bar and said axles being positioned generally at longitudinal midpoints of said axles, each of said axles having a pair of ends, each of said ends of said axles having a wheel thereon, each of said wheels having an inside portion and an outside portion such that said inside portion of said wheels are rotationally coupled to said ends of said axles, each of said wheels having a perimeter surface between said inside and outside portions, said wheels being adapted to ride on said upper rail of said first and second rails, wherein said perimeter surface of each of said wheels is concave;

a pair of tires for supporting said trailer on a roadway, one of said tires being mounted to an outside portion of each of said wheels which are mounted to said second axle, said tires having a circumference greater than the wheels to which they are attached;

wherein said first axle is closer in proximity to said proximal end of said rail than is said third axle; and wherein said elongate bar has an end adapted to be removably coupled to said electric winch.

* * * * *